United States Patent [19]

Sumida

[11] 4,287,503

[45] Sep. 1, 1981

[54] RUNNING DATA CENTRAL DISPLAY ARRANGEMENT FOR MOTOR VEHICLES AND THE LIKE

[75] Inventor: Shizuo Sumida, Hiroshima, Japan

[73] Assignee: Toyo Kogyo Co., Ltd., Hiroshima, Japan

[21] Appl. No.: 950,519

[22] Filed: Oct. 11, 1978

[30] Foreign Application Priority Data

Oct. 13, 1977 [JP] Japan ..... 52/123343

[51] Int. Cl.[3] ..... G08B 19/00

[52] U.S. Cl. ..... 340/52 F; 307/10 R; 340/518; 340/706; 340/715

[58] Field of Search ..... 340/52 F, 518, 715, 340/706; 307/10 R; 364/424

[56] References Cited

U.S. PATENT DOCUMENTS

| | | | |
|---|---|---|---|
| 3,964,018 | 6/1976 | Strait et al. | 340/52 F |
| 3,964,302 | 6/1976 | Gordon et al. | 340/52 F X |
| 4,031,363 | 6/1977 | Freeman et al. | 364/424 |
| 4,035,764 | 7/1977 | Fujinami et al. | 340/52 F |
| 4,109,235 | 8/1978 | Bouthors | 340/52 F |
| 4,140,996 | 2/1979 | Leitch et al. | 340/52 F |

*Primary Examiner*—John W. Caldwell, Sr.
*Assistant Examiner*—Joseph E. Nowicki
*Attorney, Agent, or Firm*—Wenderoth, Lind & Ponack

[57] ABSTRACT

A running or driving data central display arrangement for motor vehicles and the like in which a plurality of indications, (for example, an abnormal operating state or trouble warning display, a response display for providing information readouts according to call instructions entered by a driver, and a time display), are centralized into a single display portion for enabling a reduction in the mounting space required for the display unit and also enabling the easy facilitation of reading the indications provided by the display unit.

4 Claims, 6 Drawing Figures

RUNNING DATA CENTRAL DISPLAY ARRANGEMENT FOR MOTOR VEHICLES AND THE LIKE

BACKGROUND OF THE INVENTION

The present invention relates to a display arrangement for motor vehicles and the like and more particularly, to a central display arrangement of running or driving data for motor vehicles, etc. in which a plurality of indications, (for example, an abnormal operating state or trouble warning display function for indicating an abnormal operating state or troubles at selected inspection positions of a motor vehicle, a response display indication function for display selected running conditions of a motor vehicle in response to call instructions entered by a driver, and also a time indicating display function), are centralized in a single display portion.

Following the recent trend towards improvements in quality directed toward the manufacture of a higher class of motor vehicles, new diversified equipment have been employed and, for example, besides providing an ordinary stereophonic player and digital clock, etc., which are commonly provided in motor vehicles, and in addition to providing the abnormal operating state or trouble warning display devices, (i.e., the so-called safety monitors for indicating detected problems such as the wearing out of brake pads, broken filaments of various lamps, etc.), a response display device is provided which indicates, in response to call instructions entered by a driver, the average fuel cost, the estimated fuel requirements until arrival at a predetermined destination, the expected time of arrival at the predetermined destination the average vehicle speed, etc. Such response display indications are provided through direct utilization or processing by the calculation of the measured data signals, (for example, of running distance, vehicle speed, remaining fuel, running time and the like), which vary as the motor vehicle continues to run.

The abnormal operating state display device, the response display device, the clock used as the time display device, etc. as described above are commonly mounted separately on an instrument panel or other portions of the motor vehicle where they are readily observed by the driver, and it has been a conventional practice to provide independent display portions for the abnormal operating state display device and response display device, despite the fact that these two devices have an extremely small indicating frequency with a low working efficiency as compared with the time indicating device, (i.e.—clock) which continuously indicates the time.

The conventional arrangement as described above, however, has disadvantages in that it is difficult to secure sufficient mounting space concentrated at a limited position which may be readily inspected by a driver, and the display indications can not be conveniently read, if such display portions are not centralized at one position.

SUMMARY OF THE INVENTION

Accordingly, an essential object of the present invention is to provide a running data central display arrangement for motor vehicles and the like in which a plurality of indications, (for example, an abnormal operating state display, a response display and a time display), are centralized in a single display unit for enabling the reduction in the mounting space of the display portion and for enabling the easy facilitation of reading the indications.

Another important object of the present invention is to provide a running data central display arrangement of the above described type which is simple in construction and accurate in functioning and can be incorporated into various motor vehicles at a low cost.

In accomplishing these and other objects, according to one preferred embodiment of the present invention, the running data central display arrangement for motor vehicles includes a preference signal selection section which applies output signals to the display portion in the preference order of 1—an output signal from an abnormal operating state signal generating section which outputs an abnormal operating state signal upon occurrence of the abnormal state or troubles at the selected positions of the motor vehicle requiring checking, 2—an output signal from a measured data signal generating section which outputs various measured data varying as the motor vehicle runs, and 3—an output signal from a time signal generating section. By erasing the time display which does not give rise to any particular inconvenience, even if erased temporarily, the abnormal state signal is displayed on the display portion during an occurrence of an abnormal operating state at one of said positions requiring checking. Upon call instructions by a driver in cases other than the occurrence of the abnormal operating state, the measured data signal is displayed on said display portion according to said call instructions.

By the arrangement as described above, for example, three indications, (i.e., the abnormal state display, response display and time display), are centralized at a single display portion, with consequent reduction of the mounting space required for the display portion and also improving facilitation of reading the display.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals and symbols throughout several views of the accompanying drawings.

DETAILED DESCRIPTION OF THE INVENTION

Figure 1:
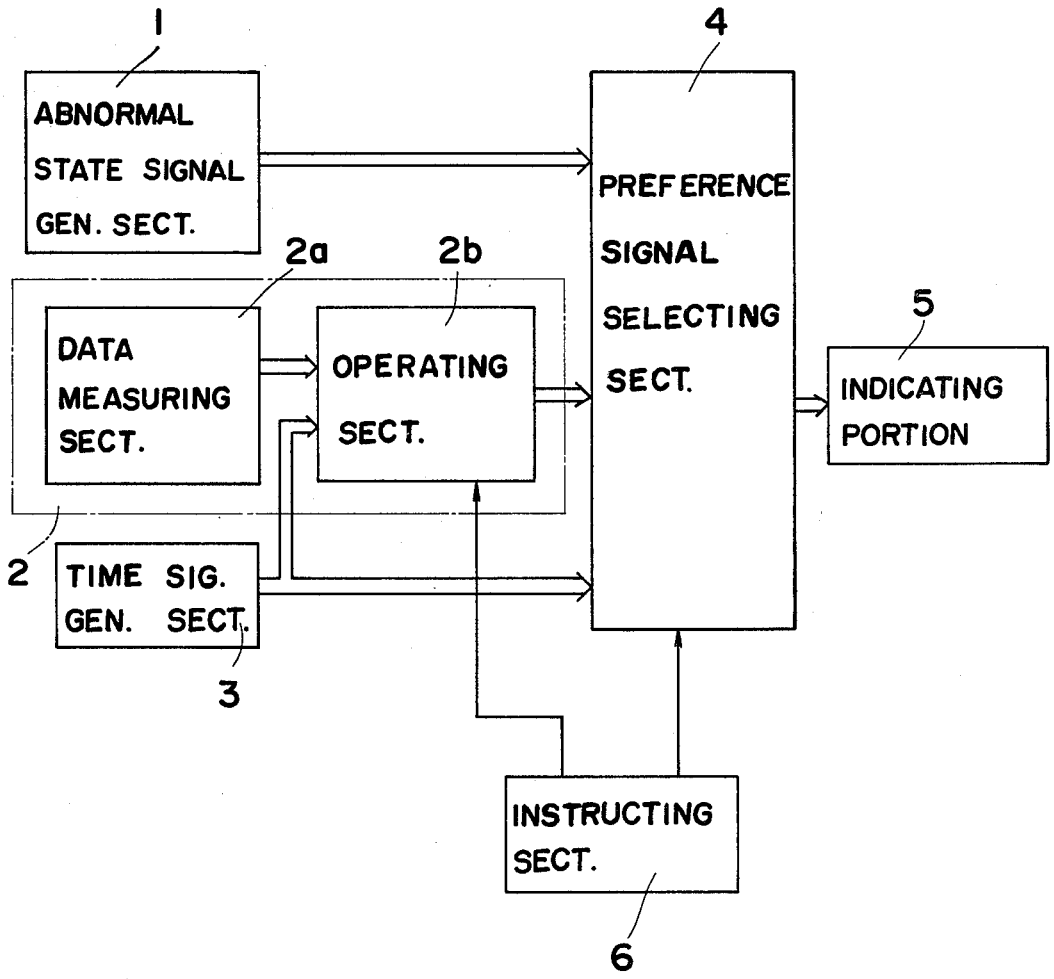
FIG. 1 is a block diagram showing the construction of a running data central display arrangement for motor vehicles according to one preferred embodiment of the present invention.

Referring now to the drawings, there is shown in FIG. 1 a block diagram of a running data central display arrangement according to the present invention which generally includes: an abnormal state or trouble signal generating section 1 coupled to a preference signal selecting section 4 which is in turn coupled to a display portion 5, a measured data signal generating section 2 further including a data measuring section 2*a* and an operating or calculating section 2*b* which processes output signals from the data measuring section 2*a* through mathematical calculations, with section 2*a* being coupled to section 2*b* which is coupled to the preference signal selecting section 4, a time signal generating circuit 3 coupled to the operating section 2*b* and also to the preference signal selecting section 4, and an instructing section 6 connected to the operating section 2*b* and the preference signal selecting section 4.

The abnormal state signal generating section 1 calculates, at the operating section 2*b*, signals obtained at the data measuring section 2*a* as well as the abnormal state such as brake pad abrasion, broken filaments of lamps, etc. by sensors (not shown) provided at selected positions of the motor vehicle requiring checking and outputs abnormal state signals, for example, a signal indicating that the remaining amount of fuel is less than 10 liters, a signal indicating that the oil requires maintenance, etc.

On the other hand, the measured data signal generating section 2 measures, at the data measuring section 2*a*, running data such as the speed, running distance, remaining amount of fuel, running time period, etc. of the motor vehicle, which vary with the driving of the motor vehicle and converts these data signals into binary signals for output as the measured data signals. Alternatively, the measured data signal generating section 2 calculates, at the operating section 2*b*, average fuel consumption, estimated fuel amount required to reach a predetermined destination, estimated arrival time, average running speed, etc. in accordance with the instructions from the instructing section 6, for output as the measured data signals.

The abnormal state signal and the measured data signal, together with time signal output from the time signal generating section 3, are applied to the preference signal selecting section 4, which inputs these signals into the display portion 5 in the preference order of the abnormal state signal, measured data signal and time signal. Upon occurrence of any abnormal state at the checking positions of the motor vehicle, the display portion 5 displays the contents of the abnormal state signal in preference to other two signals, while when the checking positions of the motor vehicle are normal, the display portion 5 displays the measured data signal required by the driver according to the call instruction signal from the instructing section 6. Similarly, in cases other than the above, the time is displayed at the display portion 5.

Figure 2:
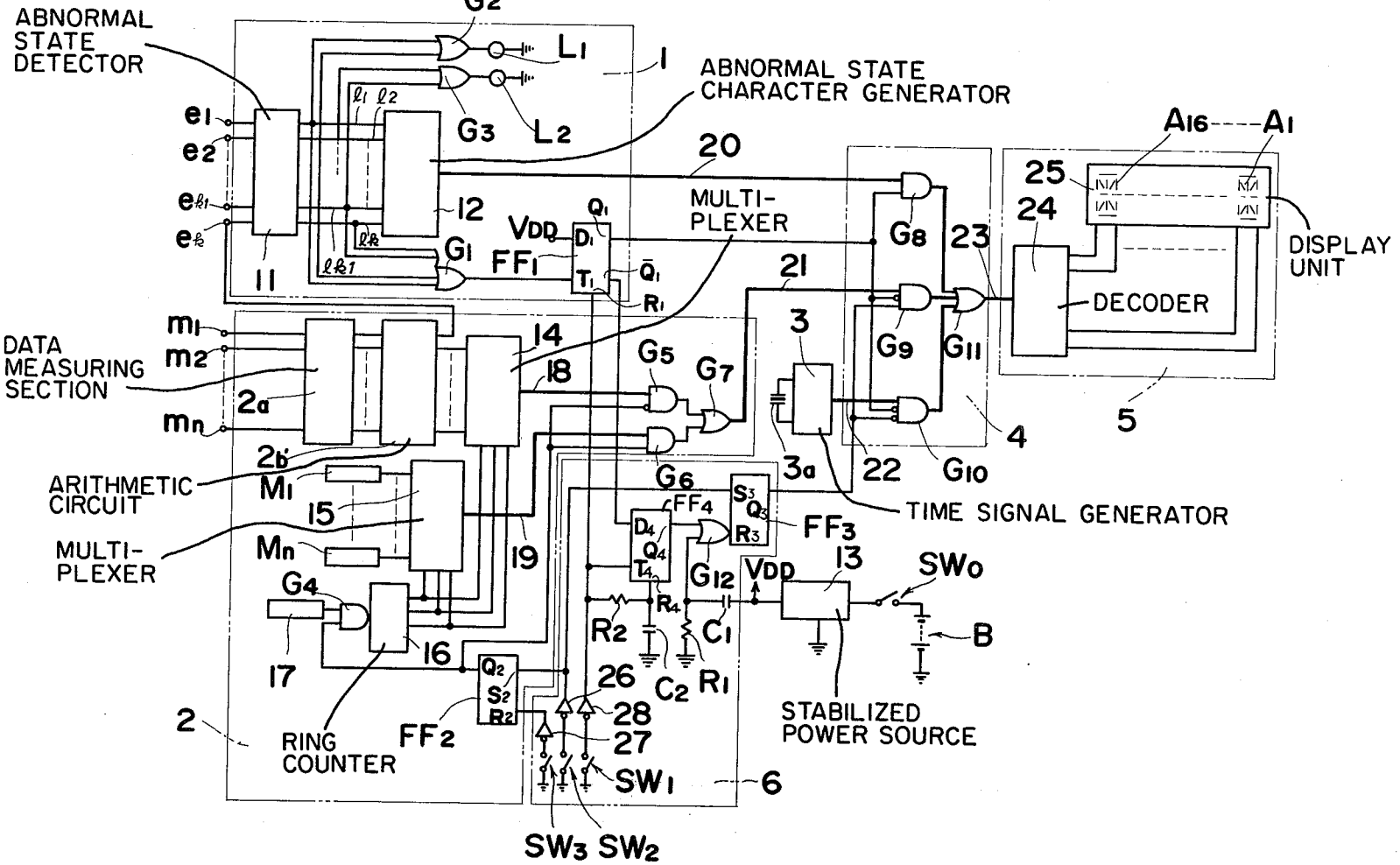
FIG. 2 is an electrical circuit diagram of the running data central display arrangement of FIG. 1, FIG. 3(*a*) is an output circuit for a measuring data signal generating section employed in the arrangement of FIG. 2, FIG. 3(*b*) is an electrical circuit diagram showing in detail the construction of a preference signal selecting section employed in the arrangement of FIG. 2.

Referring to FIG. 2, there is shown an electrical circuit diagram of the running data central display arrangement of FIG. 1, with portions corresponding to the respective blocks of the abnormal state signal generating section 1 through instructing section 6 in FIG. 1 being surrounded by chain lines.

In FIG. 2, the abnormal state signal generating section 1 generally includes an abnormal state detecting circuit 11, an abnormal state character code generation circuit 12 which ouputs binary signals predetermined in accordance with items of the abnormal state (names of the checking positions), and a flip-flop $FF_1$ of data-type (hereinafter referred to as D flip-flop) for storing the detection of the abnormal state by the abnormal state detecting circuit 11.

The abnormal state detecting circuit 11 is composed of, for example, K sets of discriminator circuits such as Schmidt trigger circuits (not shown) provided to correspond with the K sets of checking portions for the motor vehicle. When the abnormal state signals are applied to the input terminals e1, e2, . . . , and ek of the circuit 11 from the abnormal state detecting sensors (not shown) which are composed of sensor switches or the like provided on said checking positions, the potentials for signal lines l1, l2, . . . lk which connect the output of each of the discriminating circuits with the abnormal state character code generating circuit 12 are rendered to be High (represented by "H" hereinbelow).

The abnormal state character code generating circuit 12 is composed of for example, a diode matrix and other circuits. When li (i=1, . . . , k) of the signal lines l1, l2, . . . and lk has become "H" through the detection of an abnormal state by one of said checking positions, a binary signal (of at least four bits when there are no more than 16 sets of checking positions where sensors are provided) is outputted, said signal predetermined in accordance with the number i of the signal line li .

Meanwhile, the output voltage VDD (for example, five volts) of a stabilized power source 13, powered by battery B which is switched on and off by an ignition switch SWo, is applied to the data input D1 of the D flip-flop $FF_1$ to normally provide the "H" state. On the other hand, the output from k input or gate GI to which the signals from the signal lines l1 to lk are applied is input to a trigger pulse terminal $T_1$, whereby in the flip-flop $FF_1$, when at least one of the signal lines l1 to lk becomes "H", namely, when an abnormal state takes place in any one of the checking positions, data input D1="H" is loaded as trigger pulse input T1="H", with the output $Q_1$ rendered to be "H" for storing the fact that the abnormal state has taken place at at least one of the checking positions.

In the present embodiment, for the abnormal state at particularly important checking positions, the output of the abnormal character code generating circuit 12 is applied to the display portion 5 to display the abnormal state. On the other hand, outputs of the lines which become "H" with respect to the abnormal state, for example, outputs of the lines l1, l2, and lk-1, etc. of the signal lines l1 to lk are applied to OR gates $G_2$ and $G_3$ to illuminate the abnormal state display lamps $L_1$ and $L_2$ to thereby again inform the driver of the occurrence of the abnormal state.

Subsequently, the measured data signal generating section 2 includes the data measuring section 2*a* mentioned in FIG. 1, an arithmetic or operation circuit 2*b*′ constituting an operation section 2*b*, a multiplexer 14 for measured data signal selection, which selects the running data signals of the motor vehicle from the arithmetic circuit 2*b*′ by means of the instructions of the instructing section 6, another multiplexer 15 for measuring item selection, which selects the output signal from n sets of character code generating circuit M1 to Mn each generating binary signals indicating the running data items, a ring counter 16, and an RS flip-flop $FF_2$ for calling out the running data. The components as described above constitute the output control circuit of the arithmetic section 2b, together with an oscillator 17 and an AND gate $G_4$.

The data measuring section 2a is composed of an A/D conversion circuit, etc. for converting the running data into binary signals, the running data being applied into input terminals ml to mn from n sets of sensors (not shown) which measure the remaining fuel amount, running distance, vehicle speed, etc. which vary as the motor vehicle runs. The converted output signals are applied to the arithmetic circuit 2b' which is composed of a memory unit such as a microprocessor and read-only memory (ROM) or random access memory (RAM), etc.

The arithmetic circuit 2b' performs a predetermined calculation in accordance with a program stored in the read-only memory, for example, the data processing operation of multiplication and division to obtain the average running speed from the running distance and running time, and the average fuel consumption from the consumed fuel and running distance. Meanwhile, the arithmetic circuit 2b' performs the data processing operations, for example, to obtain the driving information through comparison of time required for the motor vehicle to pass major points such as post office, hospital, interchange, gas station, etc. on the road with the actual running distance and running time, in accordance with the program stored in the random access memory to suit the driver's desire, for example, in accordance with the control program of the driving schedule in which these major points on the road are plotted.

Meanwhile, the ring counter 16 controls the mutiplexers 14 and 15 respectively by its output. When the RS flip-flop $FF_2$ is set so that the output $Q_2$ becomes "H", the AND gate $G_4$ is opened to input clock pulses from the oscillator 17. The contents of the output signal is repeatedly circulated for output and the multiplexer 14 inputs the measured data developed by the arithmetic circuit 2b' to an inhibit circuit $G_5$, which has the output $Q_2$ of the RS flip-flop $FF_2$ as inhibit input. On the other hand, the other multiplexer 15 selects the character code of the measuring items corresponding to the above described measured data for input thereof to the AND gate $G_6$ which receives at one side thereof the output $Q_2$ of the RS flip-flop $FF_2$.

Figure 3:
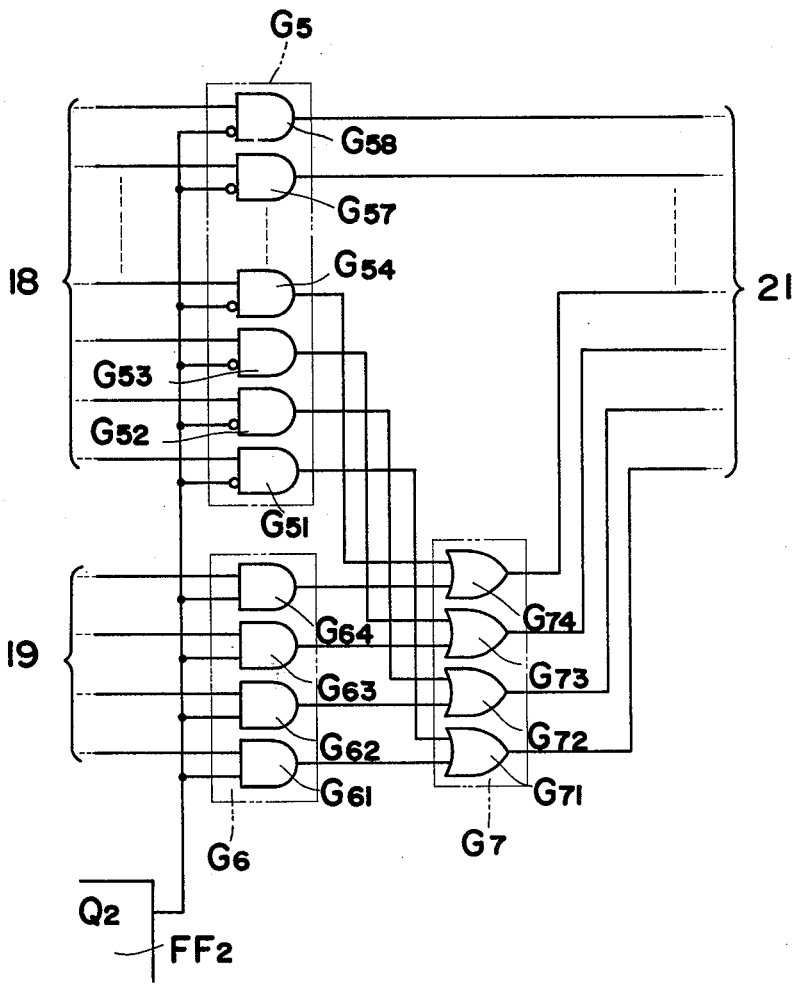
Figure 3B:
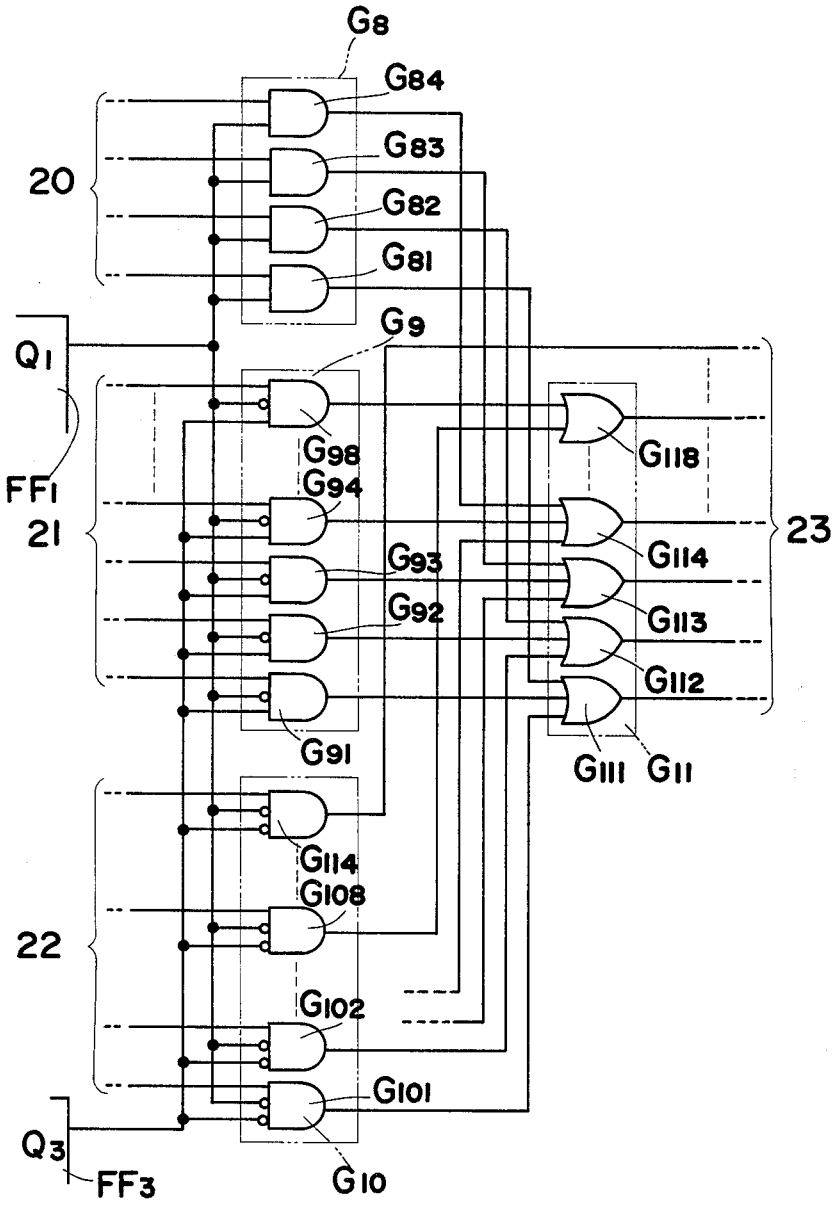

In FIG. 2, the two gates $G_5$, $G_6$ and OR gate $G_7$ to which these two outputs are applied are respectively represented by one gate. However, as shown in FIG. 3(*a*), the inhibit gate $G_5$ is composed of eight inhibit gates $G_{51}$ to $G_{58}$ when the output of the multiplexer 14 is developed as, for example, eight-bit parallel binary signals, and the output $Q_2$ of the RS flip-flop $FF_2$ is applied to each of the inhibit inputs. Meanwhile, output of the multiplexer 14 is applied to the other input from an eight-bit data bus 18 (which is represented by a thick solid line in FIG. 2. The same can be applied to the other data buses). On the other hand, the gate $G_6$ is composed of four two-input AND gates $G_{61}$ to $G_{64}$ (FIG. 3(*a*)) when the character code generating circuits $M_1$ to $M_n$ output four bit parallel binary signals, and the output $Q_2$ of the RS flip-flop $FF_1$ is applied to one input of the gates 61 to 64, while the output of the multiplexer 15 is input from the four-bit data bus 10 to the other input thereof.

The outputs of four inhibit gates $G_{51}$ to $G_{54}$ (namely, gates for controlling the lower four-bits of the measured data) of the inhibit gates $G_{51}$ to $G_{58}$ and the outputs of the AND gates $G_{61}$ to $G_{64}$ are applied to four OR gates $G_{71}$ to $G_{74}$ (FIG. 3(*a*)) which constitute the OR gate $G_7$. The outputs of these OR gates $G_{71}$ to $G_{74}$, together with the outputs of the remaining inhibit gates $G_{55}$ to $G_{58}$, are applied to the preference signal selecting section 4 through the data bus 21.

Subsequently, in the time signal generating section 3 of a conventional crystal oscillation system employing crystal 3a, the output signal thereof is applied to the preference signal selecting section 4.

In the preference signal selecting section 4, the AND gate $G_8$ and the inhibit gates $G_9$, and $G_{10}$ are composed of four two-input AND gates $G_{81}$ to $G_{84}$, eight inhibit gates $G_{91}$ to $G_{98}$ and inhibit gates $G_{101}$ to $G_{114}$ of fourteen two-inhibit inputs as shown in FIG. 3(*b*), in accordance with the number of bits of the respective output signals of the abnormal state signal generating section 1, measured data signal generating section 2 and time signal generating section 3 as described in FIG. 3(*a*).

The output signal of the abnormal state character code generating circuit 12 is applied to each one input of the AND gates $G_{81}$ to $G_{84}$ through a data bus 20. The output signal of the OR gate $G_7$ is applied to the inhibit gates $G_{91}$ to $G_{98}$ through the data bus 21. Similarly, the time signal of the time signal generating section 3 is input to each of the inhibit gates $G_{101}$ to $G_{114}$ of the two-inhibit input through a data bus 22.

Furthermore, the output $Q_1$ of the D flip-flop $FF_1$ is input to the other input of the AND gates $G_{81}$ to $G_{84}$, to the inhibit input of the inhibit gates $G_{91}$ to $G_{98}$, and to each one inhibit input of the inhibit gates $G_{101}$ to $G_{114}$ of the two-inhibit input. When the relation of output $Q_1$="H" has been established (namely, the abnormal state has occurred in the checking positions), the gates $G_{81}$ to $G_{84}$ are opened and all the remaining gates are closed.

Similarly, the output $Q_3$ of the RS flip-flop $FF_3$, which is provided in the instructing section 6 (to be described later) and controlled by the calling instructions by the driver, is applied to another input of each of the inhibit gates $G_{91}$ to $G_{98}$ to the other inhibit input of each of the inhibit gates $G_{101}$ to $G_{114}$.

The respective outputs of the AND gates $G_{81}$ to $G_{84}$, four inhibit gates $G_{91}$ to $G_{94}$ of the inhibit gates $G_{91}$ to $G_{94}$ and four gates $G_{101}$ to $G_{104}$ of two-inhibit input gates $G_{101}$ to $G_{114}$ are input to the respective three-input OR gates $G_{111}$ to $G_{114}$. The outputs of the remaining inhibit gates $G_{95}$ to $G_{98}$ and the outputs of the two-input inhibit gates $G_{105}$ to $G_{108}$ are applied to the two-input OR gates $G_{118}$, respectively.

The eight OR gates $G_{111}$ to $G_{118}$ constitute a gate $G_{11}$ in FIG. 2. Each of the outputs, together with the outputs of the remaining gates $G_{109}$ to $G_{114}$ of the two-input inhibit gates $G_{101}$ to $G_{114}$, enter the display portion 5 through a data bus 23.

The above display portion 5 is composed of a decoder 24 and a display unit 25, which illuminates its segments through the output signal of the decoder 24 to display the input signal contents of the decoder 24 in the form of an alphabet and numbers. The display unit 25 is composed of fourteen segments of display A1 to display A16 arranged sideways by, for example, sixteen displays, each of the segments being composed of, for example, light emitting diodes.

Finally, the instruction section 6 includes an RS flip-flop $FF_3$ for controlling the gates $G_9$ and $G_{10}$ of the preference signal selecting section 4, a D flip-flop $FF_4$ for resetting the RS flip-flop $FF_3$, a resetting switch $SW_1$ operated by the driver, a calling-out switch $SW_2$ of the measured data items, and a data switch $SW_3$ which displays on the display unit 25 the data corresponding to the items of the measured data.

The RS flip-flop $FF_3$ is turned on by the calling-out switch $SW_2$ which sets it, together with the RS flip-flop $FF_2$, through the output of the inverter 26. The rising of the output VDD of the stabilized power source 13 during the turning-on of the ignition switch $SW_0$ is applied to a differentiation circuit composed of a resistor $R_1$ and a capacitor $C_1$ whose output is applied to OR gate $G_{12}$. The output $Q_4$ of the D flip-flop $FF_4$ is also applied to the OR gate $G_{12}$. The resetting operation of flip-flop $FF_3$ is performed by the output of the OR gate $G_{12}$.

The D flip-flop $FF_4$ uses, as the resetting signal, the differentiated output of the inverter 28 when the resetting switch $SW_1$ has been turned on, the inverter 28 driving a delay circuit composed of a resistor $R_2$ and a capacitor $C_2$. The output of the inverter 28 is directly applied to the trigger terminal $T_4$ of the D flip-flop $FF_4$ and the $Q_1$ output of the D flip-flop $FF_1$ is applied to the data terminal $D_4$ of flip-flop $FF_4$.

The data switch $SW_3$ resets the RS flip-flop $FF_2$ through the output of an inverter 27 during the turning-on of the data switch $SW_3$.

Subsequently, the operation of the arrangement according to the present invention will be described hereinafter with reference to FIG. 2 and FIG. 4.

(I) Upon turning on of the ignition switch $SW_0$ at a time t0, the rising portion of the output VDD of the stabilized power source 13 is differentiated (see FIG. 4 (*a*), and 4(*b*)) by the differentiation circuit $C_1R_1$ (hereinafter the differentiation circuit and the delay circuit are represented by symbols for resistor and capacitor). The differentiation output resets the RS flip-flop $FF_3$ to provide the relation of $Q_3$="L" (see FIG. 4(*c*)).

Figure 4:
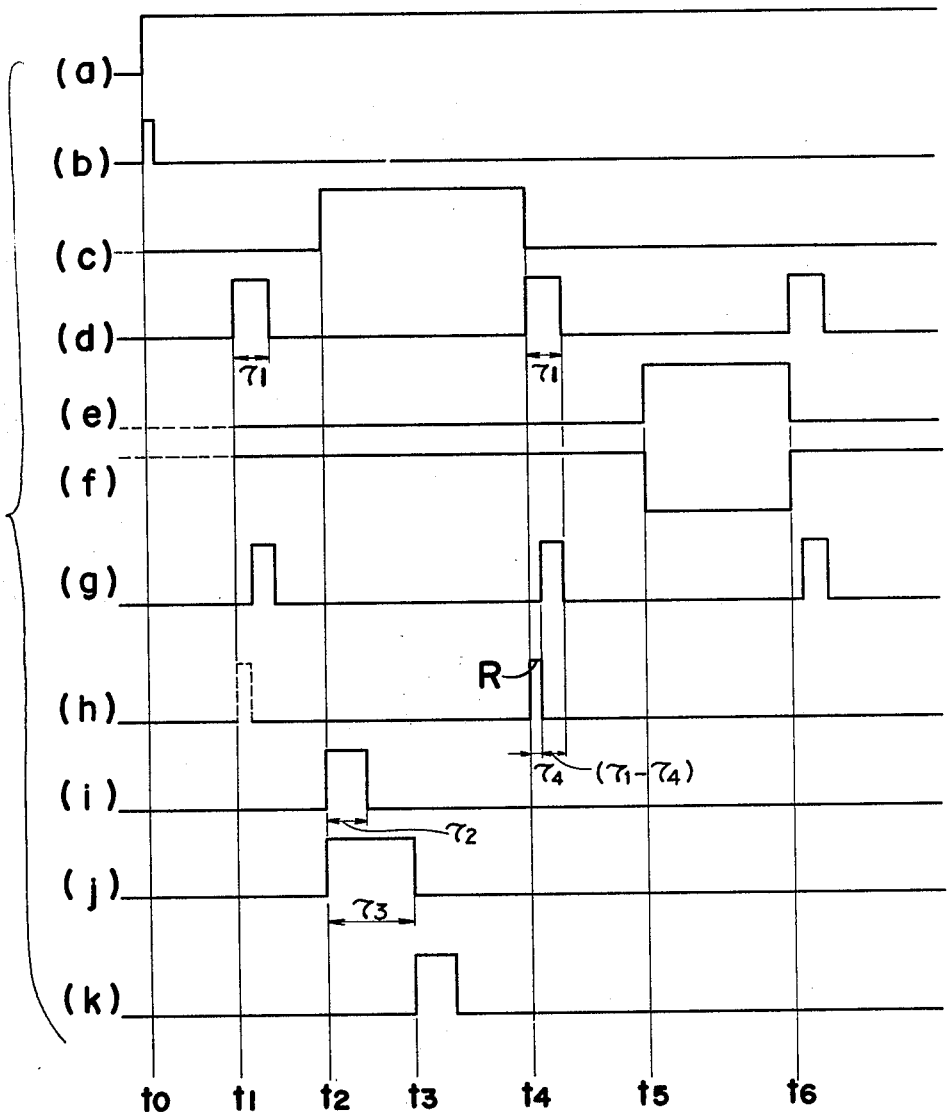
FIG. 4 is a time chart explanatory of the sequence of operation of the arrangement of FIG. 2.

In the next step, upon turning on of the resetting switch $SW_1$, at a time t1, only for a short period of time $\tau$1 (see FIG. 4(*d*)), the output of the D flip-flop $FF_1$ retains the condition of $Q_1$="L" and $Q_1$="H" (see FIG. 4(*e*), and 4(*f*)) when there is no abnormal state in the respective checking positions of the motor vehicle.

Accordingly, two inhibit inputs of the gate $G_{10}$ become "L" respectively to open the gate $G_{10}$, and the time signal is input to the display portion 5 to display the time on the display unit 25.

(II) Under the above condition, when the driver turns on the calling-out switch $SW_2$, at a time t2, only for a time $\tau$2 (see FIG. 4(*i*)), the RS flip-flop $FF_2$ is set to provide the relation $Q_2$="H" (FIG. 4(*j*)). The AND gates $G_4$ and $G_6$ are opened, and thus the AND gate $G_4$ inputs the clock pulses to the ring counter 16 from the oscillator 17. As a result, the multiplexer 15 transmits the signals indicating the measured data items to the data bus 19 sequentially from the character code generating circuits $M_1$ to $M_n$. The signals are input from the AND gate $G_6$ to the inhibit gate $G_9$.

Incidentally, at the time t2, since the RS flip-flop $FF_3$ is also set simultaneously to provide the relation $Q_3$="H" (see FIG. 4(*c*)), the inhibit gate $G_9$ is open. As a result, the measuring data items are sequentially called out by the ring counter 16 and displayed on the display unit 25.

(III) Upon turning on of the data switch $SW_3$ (see FIG. 4(*k*)) when a desired item has been selected at a time t3 after a time period $\tau$3 from the time t2, the RS flip-flop $FF_2$ is reset to establish the relation $Q_2$="L" (see FIG. 4(*j*)). The AND gate $G_4$ is closed and the ring counter 16 stops its counting operation. The measured data signal to the item is input to the inhibit gate $G_5$ from the multiplexer 14 in accordance with the output signal of the ring counter 16 at this time.

However, since the inhibit input of the inhibit gate $G_5$ at this time is in the relation $Q_2$="L", the inhibit gate is open. Accordingly, the measured data signal is applied to the display portion 5 in the same manner as in the above item (II), with the display unit 25 displaying the measured data.

(IV) Subsequentially, when the driver turns on the resetting switch $SW_1$ at a time t4 only for a time period $\tau$1 (see FIG. 4(*d*)), the rising portion of the inverter 28 at this time is delayed by a delay circuit $C_2R_2$ (see FIG. 4(*g*)), and the resetting time of the D flip-flop $FF_4$ is delayed by the time $\tau$4, due to the delay output. During the delay time period $\tau$4, the input terminals $T_4$ and $D_4$ of the D flip-flop $FF_4$ are in the relations of $T_4$="H", $D_4$="H" (the $Q_1$ output of the D flip-flop $FF_1$ is "H") and $R_4$="L". Thus, the D flip-flop $FF_4$ is in the relation $Q_4$="H", and the resetting pulse R (see FIG. 4(*h*)) of a narrow pulse width $\tau$4 is input to the RS flip-flop $FF_3$ from the OR gate $G_{12}$ and the output $Q_3$ becomes "L" (see FIG. 4(*c*)).

Accordingly, the inhibit gate $G_{10}$ of the two-inhibit input is again opened to display the time.

(V) In the next step, when the checking positions of the motor vehicle, for example, the appropriate sensor detects that the brake pad is worn out at the time t5, and when the signal line l1 becomes "H", the output of the OR gate $G_1$ becomes "H". Since the output therefrom is applied to the trigger terminal $T_1$ of the D flip-flop $FF_1$, and D flip-flop $FF_1$ loads the input "H" of the data terminal $D_1$ to output the $Q_1$="H". Thus, the AND gate $G_8$ opens and a signal indicating the abrasion of the brake pad is input to the OR gate $G_{11}$ from the abnormal state character code generating circuit 12 to the OR gate $G_{11}$. However, at this time, the output $Q_1$="H" of the D flip-flop $FF_1$ is kept input to the inhibit input of the inhibit gate $G_9$ and to one inhibit input of the two-inhibit-input inhibit gate, and thus, inhibit gates $G_9$ and $G_{10}$ are both kept closed. Therefore, only the signal showing the abrasion of the brake pad is preferentially applied to the display portion 5, so that the display 25 displays the abrasion of the brake pad.

Meanwhile, the output of the OR gate $G_2$ becomes "H" at this time. The OR gate $G_2$ illuminates the abnormal state display lamp $L_1$ and informs the driver of the important abnormal state such as brake pad abrasion, etc., with simultaneous indication of such abnormal state on the display unit 25.

(VI) At a time period t6 after the causes of the abnormal situation have been removed, upon turning on of the resetting switch $SW_1$, resetting pulses are applied to the D flip-flop $FF_1$, and the outputs $Q_1$ and $Q_1$ thereof become "L" and "H" respectively (see FIG. 4(*d*), 4(*e*) and 4(*f*)), and thus the time is displayed again in the same manner as in the above item (IV).

(VII) When the abnormal state of the item (V) occurs during the display of the measured data according to the items (II) and (III), the output $Q_1$ of the D flip-flop $FF_1$ becomes "H", and the gates $G_9$ and $G_{10}$ are closed with the gate 8 opened. Thus, the display portion 5 displays the abnormal state.

Subsequently upon turning on of the resetting switch $SW_1$ after the causes for the abnormal state have been removed, the D flip-flop $FF_4$ does not transmit the resetting pulse R at this time, since the $Q_1$ output "L" of the D flip-flop $FF_1$ is kept applied to the data terminal $D_4$. Accordingly, the RS flip-flop $FF_3$ which is set in the items (II) and (III) remains set, and the display portion 5 displays the measured data again. The measured data display is reset in the same manner as in the above item (IV).

When the abnormal situation has occurred in the checking position of the motor vehicle in the manner as described hereinabove, the abnormal state signal has the top priority to be input to the display portion 5. On the other hand, except for the abnormal state, the display is provided by the driver's instructions. Also, except for the above-described cases, the time signal is input to the display portion 5, and thus, the signal display portion 5 can display the abnormal state, running data of the motor vehicle and the time.

Figure 5:
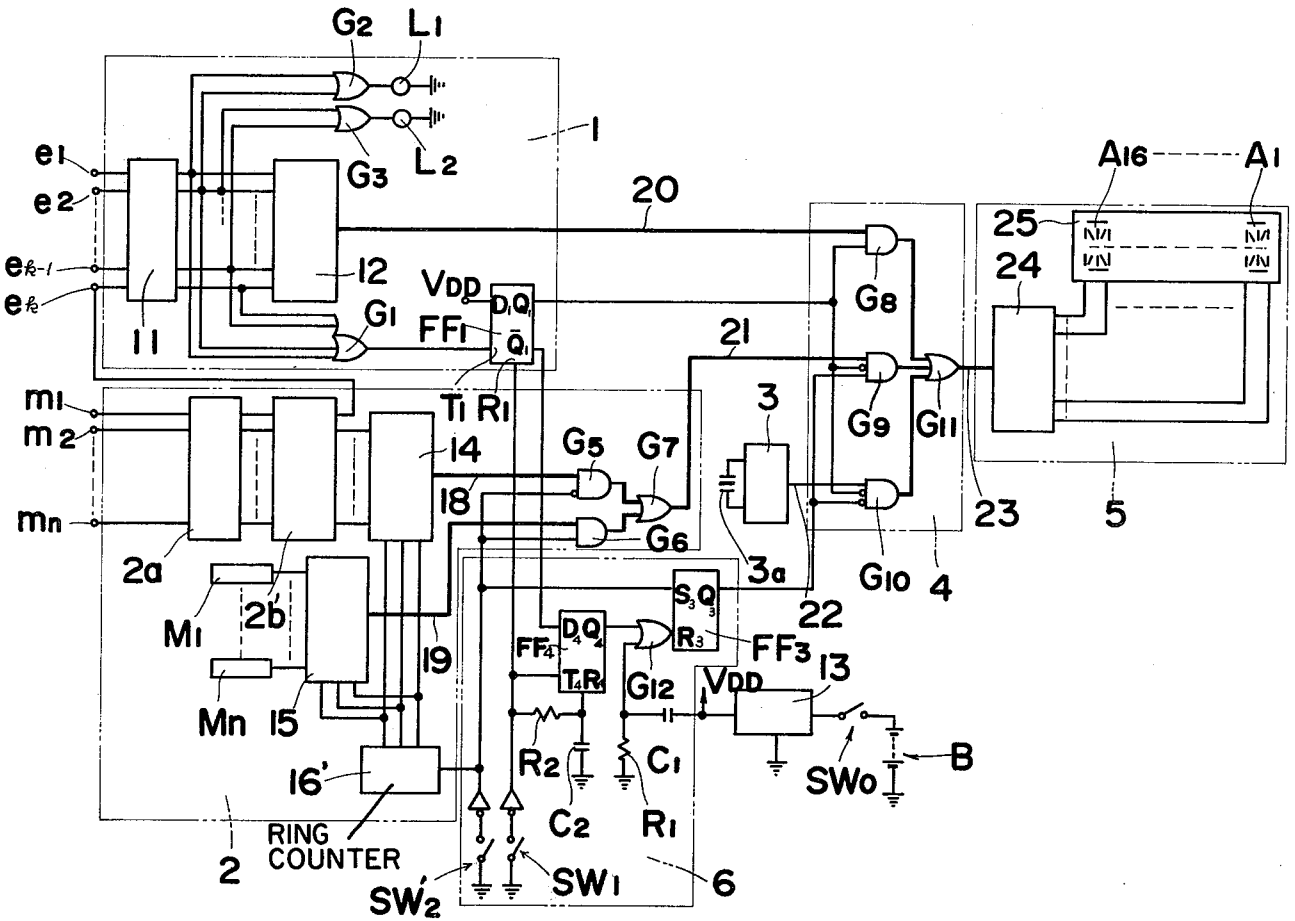
FIG. 5 is a similar view to FIG. 2, but particularly shows a modification thereof.

Subsequently, FIG. 5 shows a modified embodiment of FIG. 2. In this modification, the arrangement of FIG. 2 wherein the clock pulses are input from the oscillator 17 to the ring counter 16 to call out the data signal has been modified as follows. According to FIG. 5, a ring counter 16' is advanced everytime a calling-out switch $SW_{2'}$ is turned on, and the measuring items are selected by the multiplexer 15 for display on the display unit 25. Meanwhile, when the calling-out switch $SW_{2'}$ is off, the data signal is applied to the display portion 5 through opening of the inhibit gate $G_5$ for displaying thereon the measured value. By the modified arrangement of FIG. 5, the circuit can be simplified through omission of the oscillator 17 and data switch $SW_3$ described as employed in FIG. 2.

Since other construction and function of the modified arrangement of FIG. 5 is generally similar to the embodiment of FIG. 2, detailed description thereof is abbreviated for brevity.

It should be noted here that the present invention is not limited in its arrangements to those in the foregoing embodiments, but may be modified in various ways within the scope. For example, the output signal from the data measuring section 2*a* described as calculated in the operating circuit 2*b'* in the embodiments may be modified to be directly input to the preference signal selecting section without such calculation at the operation circuit 2*b'*.

It should also be noted that, in the foregoing embodiments, although the present invention has been mainly described with reference to the running data central display arrangement for motor vehicles, the concept of the present invention is not limited in its application to such central display arrangement for motor vehicles alone, but may readily be applicable to central display arrangements for other means of transportation in general such as aircraft, ships and the like, and for various facilities, for example, central control arrangements in processing plants, etc. wherein a plurality of indications are required to be displayed in a limited space.

As is clear from the foregoing description, according to the present invention, it is so arranged that by the provision of the preference signal selecting section, the time display which gives rise to no particular inconvenience even if erased temporarily is adapted to be erased, while the abnormal display portions are displayed during the occurrence of the sensed abnormal states and the measured data is displayed upon the initiation of call instructions by the driver at times other than during the occurrence of a sensed abnormal state, said displays all being displayed on the single display portion. By the above arrangement, not only is the mounting space for the display portion reduced, but the reading of the displayed data is markedly facilitated due to the centralized display of the information required by the driver. Moreover, owing to the small number of parts and components required for the display portion as compared with conventional display arrangements, cost reduction can be advantageously achieved.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A display system for use in a motor vehicle having a plurality of sensors for sensing the operating perameters of said vehicle at preselected locations, said display system comprising:

a time signal generator for generating a signal indicative of the time of day;

a measured data signal generator for receiving the output of at least some of said plurality of sensors and for performing arithmetic manipulation of said outputs of said sensors to generate signals corresponding to predetermined parameters of said motor vehicle, said measured data signal generator including a multiplexer means for selecting one of said outputs of said measured data signal generator in response to a multiplex control signal;

an abnormal state signal generator operatively connected to at least some of said plurality of sensors and to said measured data signal generator for generating a signal when the output of at least one of said sensors is outside its respective predetermined range and for generating a signal when at least one of the outputs of said measured data signal generator is outside its respective predetermined range, said abnormal state signal generator simultaneously generating a code signal corresponding to the sensor having an output outside said respective predetermined range and simultaneously generating a code signal corresponding to said output of said measured data signal generator having an output outside said respective predetermined range;

a preference signal selecting unit operatively connected to said time signal generator, said measured data signal generator, and said abnormal state signal generator for selectively gating, as its output, the output of one of said time signal generator, measured data signal generator, and abnormal state signal generator;

a display unit responsive to the selectively gated output of the preference signal selecting unit;

a manual operator control means operatively connected to said measured data signal generator and said preference signal selecting unit for controlling said multiplexer to control the output of said measured data signal generator inputted to said preference signal selecting unit; wherein said preference signal selecting unit comprises signal selecting means for enabling the display unit to display the output of said abnormal state signal generator when said abnormal state signal generator produces an output, for enabling the display unit to display the output of said measured data signal generator under the simultaneous occurrence of the absence of an output from said abnormal state signal generator and a manually entered control input in said manual input means, and for enabling said display unit to display the output of said time signal generator under the simultaneous occurrence of the absence of outputs from said abnormal state generator and said measured data signal generator.

2. A display system as claimed in claim 1, wherein said display unit comprises an alphabetical and numerical display having a plurality of segments.

3. A display system as claimed in claim 1, wherein said abnormal state signal generator comprises:

a plurality of level detectors, each level detector providing an output when its respective input is outside its respective predetermined range;

an OR gate operatively connected to the outputs of said level detectors for providing an output when at least one of said level detectors generates an output;

an abnormal state character generator operatively connected to said level detectors for producing a code signal corresponding to the level detector generating an output; and a flip-flop operatively connected to said OR gate for storing the occurrence of an output generated by said OR gate.

4. A display system as claimed in claim 1, wherein said preference signal selecting means comprises;

first, second and third AND gates;

said first AND gate operatively connected to the abnormal state signal generator, wherein when said abnormal state signal generator produces an output, said first AND gate is energized;

said second AND gate operatively connected to said abnormal state signal generator, said manual operator control means and said measured data signal generator, wherein when said manual operator control means produces an output, said second AND gate is energized and wherein when said abnormal state signal generator produces an output, said second AND gate is inhibited;

said third AND gate operatively connected to said abnormal state signal operator, said manual operator control means and said time signal generator, wherein when either of said abnormal state signal generator and said manual operator control means produces an output, said third AND gate is inhibited and wherein when said time signal generator produces an output, said third AND gate is energized.

* * * * *